US005919088A

United States Patent [19]

Weiss

[11] Patent Number: 5,919,088

[45] Date of Patent: Jul. 6, 1999

[54] GAMING METHOD AND APPARATUS INCLUDING A SIMULATION OF A COMBINATION SAFE

[75] Inventor: Steven A. Weiss, Las Vegas, Nev.

[73] Assignee: Casino Data Systems, Las Vegas, Nev.

[21] Appl. No.: 08/861,276

[22] Filed: May 20, 1997

[51] Int. Cl.[6] ..... A63F 9/24; A63F 5/00

[52] U.S. Cl. ..... 463/9; 463/16; 463/20; 463/25; 463/30

[58] Field of Search ..... 463/1, 9, 12–13, 463/16, 20, 25, 29–31, 36, 40–42; 364/410.1, 412.1; 273/138.2, 139, 143 R, 121 B, 292–293

[56] References Cited

U.S. PATENT DOCUMENTS

| | | |
|---|---|---|
| 4,624,459 | 11/1986 | Kaufman . |
| 4,871,171 | 10/1989 | Rivero . |
| 5,318,298 | 6/1994 | Kelly et al. . |
| 5,342,049 | 8/1994 | Wichensky et al. . |
| 5,393,057 | 2/1995 | Marnell, II . |
| 5,397,125 | 3/1995 | Adams . |
| 5,409,225 | 4/1995 | Kelly et al. . |
| 5,560,603 | 10/1996 | Seelig et al. . |

FOREIGN PATENT DOCUMENTS

| | | |
|---|---|---|
| 0558307 | 9/1993 | European Pat. Off. . |
| 3630714 | 5/1988 | Germany . |
| 3801643 | 7/1989 | Germany . |
| 5131044 | 5/1993 | Japan . |
| 2072395 | 9/1981 | United Kingdom . |
| 2083936 | 3/1982 | United Kingdom . |
| 2106293 | 4/1983 | United Kingdom . |
| 2137392 | 10/1984 | United Kingdom . |
| 2153572 | 8/1985 | United Kingdom . |
| 2170636 | 8/1986 | United Kingdom . |
| 2181589 | 4/1987 | United Kingdom . |
| 2191030 | 12/1987 | United Kingdom . |
| 2197974 | 6/1988 | United Kingdom . |
| 2202984 | 10/1988 | United Kingdom . |
| 2222712 | 3/1990 | United Kingdom . |
| 2226907 | 7/1990 | United Kingdom . |
| 2230373 | 10/1990 | United Kingdom . |
| 2273384 | 6/1994 | United Kingdom . |

*Primary Examiner*—Jessica J. Harrison
*Assistant Examiner*—Mark A. Sager
*Attorney, Agent, or Firm*—Bernhard Kreten

[57] ABSTRACT

A method and apparatus for simulating a gaming event in which a player is awarded outright for a winning combination and also allowed to participate in the incremental exposition of a potential reward subsequently based on losing, where the losing simulates unlocking the combination of a safe.

3 Claims, 3 Drawing Sheets

GAMING METHOD AND APPARATUS INCLUDING A SIMULATION OF A COMBINATION SAFE

FIELD OF THE INVENTION

The following invention relates generally to a method and apparatus for a gaming machine. More specifically, the instant invention is directed to an apparatus and method for a gaming machine having a winning outcome where the player wins directly and a non-winning outcome which leads the player to solving the combination for a simulative safe which, when the combination is discovered, provides an award.

BACKGROUND OF THE INVENTION

One common frailty in all gaming machines is the cumulative effect of successive losses. While players have been acclimated to certain precepts such as engaging a machine when the machine or player is "hot" or "on a roll", there is no concomitant shibboleth with respect to the physiological perdition associated with successive losses. As a consequence, players can become disinterested in gaming and inure to the perception of playing abatement based on the perception of a "cold streak".

The universe of games which provide a clear demarcation between winners and losers are legion in their numbers.

As an ancillary to these problems, there are games which allow players who win to enjoy a multiplicitive effect from having a special award bestowed should the win achieve a certain value against a paytable. These awards can sometimes be configured as a spinning wheel which, once the wheel stops rotating or a electronic equivalent thereof, provides a multiplier to the award paid a person already declared winner. While such games enhance the level of interest to people who already are about to have an award bestowed upon them, the problem of maintaining the interest of the vast majority of players whose original outcome are determined a loss remains unresolved.

The following patents reflect the state of the art of which applicant is aware and are included herewith to discharge the applicant's acknowledged duty to disclose known prior art. It is respectfully submitted, however, that none of these patents teach nor render obvious when considered singly or in any conceivable combination the nexus of the present invention as set forth hereinabove and as defined hereinbelow by the claims.

| PATENT NO. | ISSUE DATE | INVENTOR |
|---|---|---|
| | U.S. Patent Documents | |
| 4,624,459 | November 25, 1986 | Kaufman |
| 4,871,171 | October 3, 1989 | Rivero |
| 5,318,298 | June 7, 1994 | Kelly, et al. |
| 5,342,049 | August 30, 1994 | Wichinsky, et al. |
| 5,393,057 | February 28, 1995 | Marnell, II |
| 5,397,125 | March 14, 1995 | Adams |
| 5,409,225 | April 25, 1995 | Kelly, et al. |
| 5,560,603 | October 1, 1996 | Seelig, et al. |
| | Foreign Patent Documents | |
| GB 2 072 395A | September 30, 1981 | Kennedy |
| GB 2 083 936A | March 31, 1982 | Hurst, et al. |
| GB 2 106 293A | April 7, 1983 | Last |
| GB 2 137 392A | October 3, 1984 | Pressland, et al. |
| GB 2 153 572A | August 21, 1985 | Thomas |
| GB 2 170 636A | August 6, 1986 | Foster, et al. |

-continued

| PATENT NO. | ISSUE DATE | INVENTOR |
|---|---|---|
| GB 2 181 589A | April 23, 1987 | Wain |
| GB 2 191 030A | December 2, 1987 | Melen, et al. |
| GB 2 197 974A | June 2, 1988 | Evans |
| GB 2 202 9484A | October 5, 1988 | Rivero |
| DE 3630-714-A | November 5, 1988 | Gauselmann |
| DE 3801-643-A | July 27, 1989 | NSM Apparatebau |
| GB 2 222 712A | March 14, 1990 | Wain |
| GB 2 226 907A | July 11, 1990 | Farrell |
| GB 2 230 373A | October 17, 1990 | Lee |
| JP 405131044A | May, 1993 | Taiyo Jidoki KK |
| EP 558307-A2 | January 9, 1993 | Edward |
| GB 2 273 384A | June 15, 1994 | Crossman, et al. |

SUMMARY OF THE INVENTION

The instant invention is distinguished over the known prior art in a multiplicity of ways. When considered from one facet thereof, the instant invention allows a person who has not won a game on its face to still participate in solving a longer term problem or conundrum the resolution of which can inure to the benefit of the player once the problem or conundrum has been solved. This can retain player interest during protracted periods of successive losses by the player on the game in chief without a concomitant disillusionment with respect to ever overcoming a cold streak or a series of losses which defy resolution.

At its broadest scope, the instant invention provides a direct outcome from play involving a wager by the player after which an award is bestowed upon the player contingent upon the outcome being correlative with an established paytable that is preannounced and within the expectation of the player. Assume, however, that the outcome is not contemplated by the paytable. The instant invention encompasses this scenario by providing the player with an iterative process by which a second award can be ultimately won by the player provided that the player or subsequent players, should the initial player and successive players leave, persevere. In a preferred form of the invention, the gradual exposition of the award which inures to the benefit of the player or subsequent players involves the revealing of a combination to a simulative safe, the combination of which is randomly determined and exposed to the player only in a series of successive steps based on successive losses. In this way, as a player continues to enjoy the benefits of playing the machine and partake in the awards bestowed upon outcomes correlative with the paytable, the player can also achieve a payout which is defined by and triggered by the iterative outcome of successive plays based on a game which is not recognized by the paytable. In this manner, the interest of the player can be maintained and the prospect of an award can be enhanced even though each individual outcome does not directly correlate with a winning outcome on the paytable.

OBJECTS OF THE INVENTION

Accordingly, it is a primary object of the present invention to provide a new, novel and useful instrumentality for rewarding a player whether the player wins or loses on a primary game which correlates with the paytable.

A further object of the present invention is to provide a device and method as characterized above which is intuitively simple to understand and ultimately allows the player to become a beneficiary of an award as a function of time even when a primary game associated with the machine does not award the player immediately and directly.

A further object of the present invention is to provide a device and method as characterized above which is durable in construction and lends itself to mass production techniques.

Viewed from a first vantage point, it is an object of the present invention to provide a method for playing a gaming machine simulating a safe having a combination, the steps including: selecting a combination, keeping the combination a secret from a player, playing a game, evaluating an outcome of the game against a paytable, incrementing credit to the player if the outcome is found on the paytable, searching for the combination of the safe if the player does not have an outcome which is due an award from the paytable, and flagging a combination number when found.

Viewed from a second vantage point, it is an object of the present invention to provide a method for gaming, comprising the steps of: making a wager to enable a gaming machine, evoking chance means to trigger an outcome, comparing the outcome to a paytable, awarding credits if the outcome is to be found on the paytable, advancing a solution to a randomly generated puzzle if the outcome is not found on the paytable, and awarding a prize upon discovery of the puzzle.

Viewed from a third vantage point, it is an object of the present invention to provide an apparatus for wagering, comprising, in combination: wagering means to enable said apparatus, means for displaying a plurality of outcomes, means for displaying a combination of a simulative safe, means for incrementing an award due in the presence of a winning outcome, means for revealing portions of the combination as a function of a losing outcome, means for awarding a payout upon discovery the combination.

These and other objects will be made manifest when considering the following detailed specification when taken in conjunction with the appended drawing figures.

DESCRIPTION OF PREFERRED EMBODIMENTS

Figure 2:
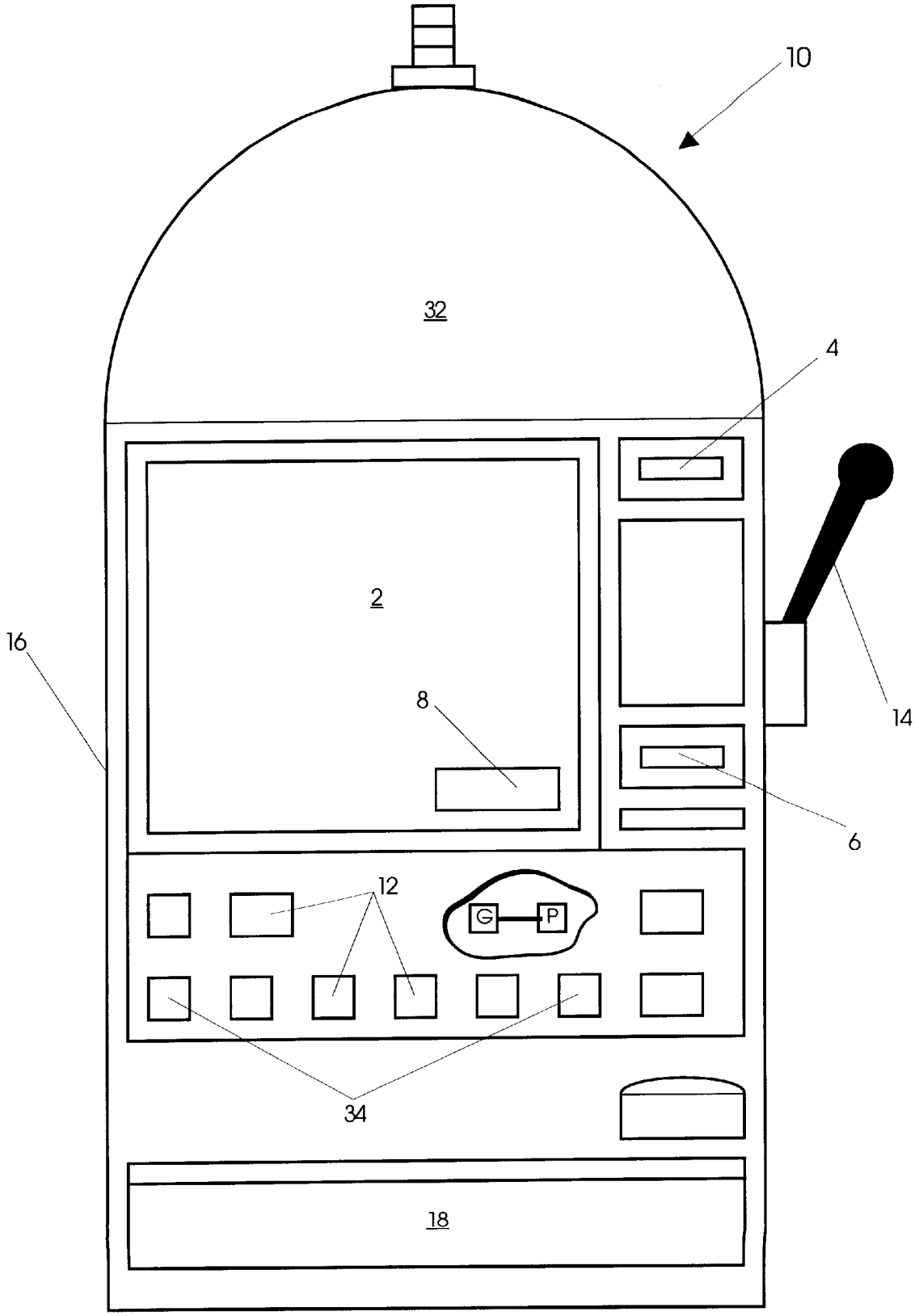
FIG. 2 is a depiction of the apparatus associated therewith.

Considering the drawings, wherein like reference numerals denote like parts throughout the various drawing figures, reference numeral 10 as shown in FIG. 2 is directed to the apparatus according to the present invention.

In its essence, the apparatus 10 includes a housing 16 which supports a video monitor 2 therewithin. The monitor 2 may include a window 8 for special messages or for incrementing counting of credits accumulated by the player. The machine also includes an LED readout for prompting the player and providing verbiage to stimulate the player as shown by LED readout 4 and an inlet for the reception therein of coins, currency or the like to auger in the inception of play. A plurality of decision making buttons 12 are also located on the face of the machine 10, preferably below the display and a pull handle 14 can be used to initiate play as an alternative to supplement the decision making buttons 12. A coin hopper 18 may be included to effectuate an output of an award due the player. The machine 10 may have a top portion with a display thereon having a static motif correlative with the game to be played. A plurality of speakers 34 may be included on the machine for aural interaction with the player.

Figure 3:
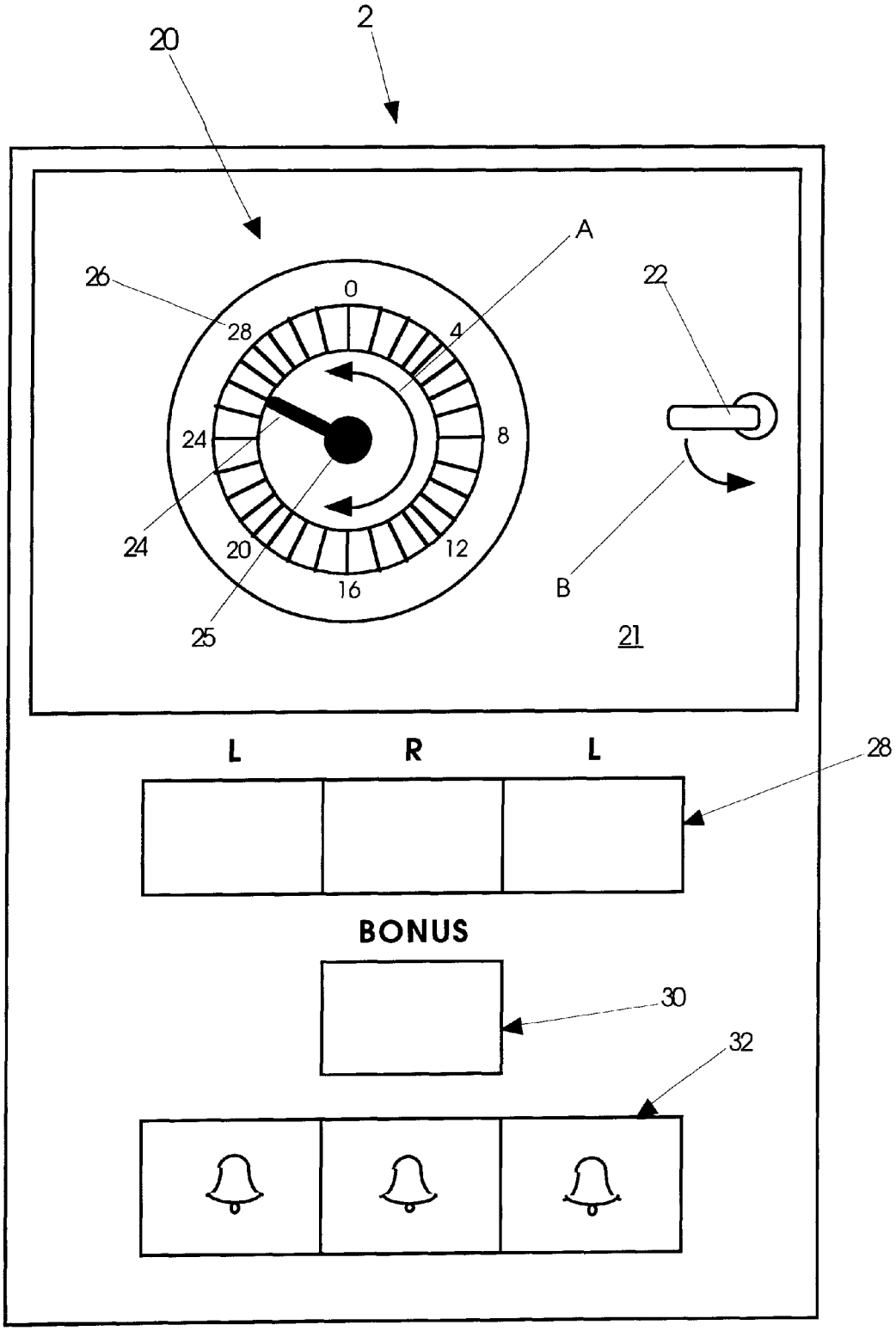
FIG. 3 is a close-up depiction of the display screen shown in FIG. 2 and detailing the nuances of the present invention.

More specifically, and with reference to FIG. 3, greater details with respect to the video display apparatus 2 can be explored. As shown, the video display 2 includes a display area 20 simulative of a safe including a safe door 21 having a safe handle 22 which moves along the direction of the arrow "B" signaling unlocking the safe. In addition, the safe includes a combination dial having a knob 25 which can be spun in the direction of the double-ended arrow "A" and the knob 25 is integrally formed with a dial escutcheon upon which a line 24 is emblazoned which correlates with a series of gradations 26 evocative of a combination that needs to be reconciled with the knob 25.

In use and operation, the knob 25 and its associated escutcheon and indicator line 24 are rotated about the arrow "A" incrementally by the machine during the course of play when a player loses to ultimately discern the combination of the safe. As the combination of the lock is discerned, the numbers associated with the combination are displayed in display panel 28. For illustrative purposes, a combination of left (counter clockwise), right (clockwise) and left (counter clockwise) are displayed so that as the player successively loses during subsequent plays, the line 24 is advanced in either of the two directions by a machine processor P until the combination of the safe has been located.

Once the numbers associated with the combination have been located, the dial will rotate in an opposite direction as reflected in the display 28. It is contemplated that in a preferred form of the invention, three numbers are correlative of winning the game for people who do not achieve an award based on an outright win. This will be explained subsequently.

The bottom box 32 of the video display 2 shows three bells. This is correlative of a pay line where the player achieves an award outright. When a player achieves an outright award, the combination to the lock does not further developed. However, when the primary game 32 does not reflect an outright winner, the dial 25 of the combination lock to the safe is indexed either to the left or to the right and incrementally advances the player's opportunity for a win based on "cracking" the combination of the safe. Once the player has cracked the combination to the safe, the bonus box 30 provides a random generation G of a number, preferably a whole number integer multiple from one to ten which enriches the player based on a subsequent spin of the reel as reflected in the boxes 32 automatically. The boxes 32 are allowed to rotate continuously until a pay is recognized on the paytable. Once the pay out amount of the paytable has been recognized, the whole number integer reflected in the bonus box 30 is multiplied against the paytable to increment an award to the player.

Figure 1:
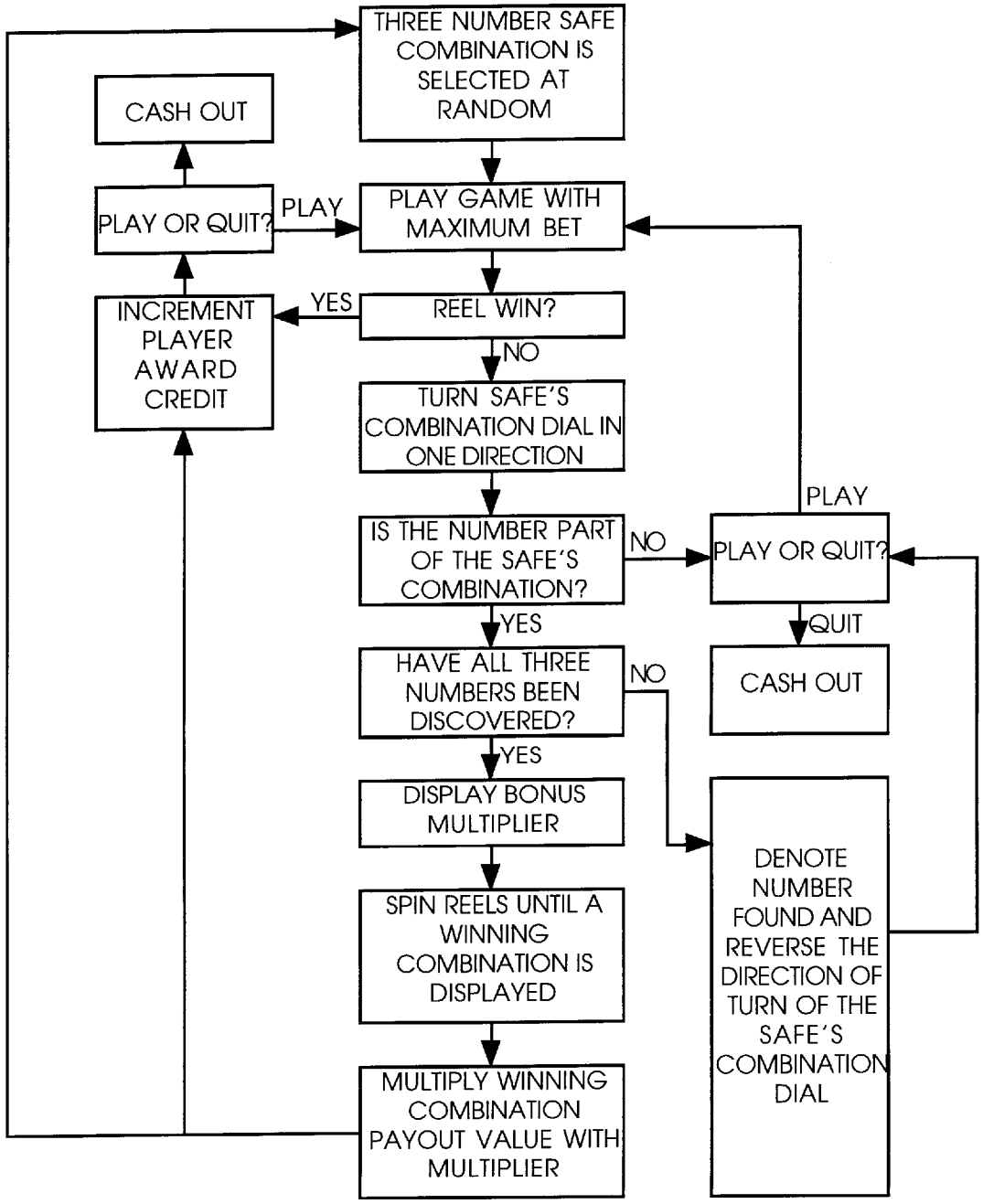
FIG. 1 is a flow chart of the methodology according to the present invention.

Referring to FIG. 1, the flow chart associated with the apparatus of FIGS. 2 and 3 can be explored. Initially, the three number safe combination is selected at random. Next, the player plays the game either with a maximum bet or less. If the game is played with less than a maximum bet then the outcome is determined solely by the outcome associated with the three reels 32 displayed in FIG. 3. Should the player elect to play with the maximum bet then the first decision is whether or not the end reel setting wins outright. If the reel wins outright, then the player is incremented with an award credit based on a pay table. The player is then given an option to play or quit and cash out. Should the reels not derive an instant win for the player, the safe combination dial is turned in one direction and an analysis is made whether or not the number associated with the safe combination has been arrived at. If the combination has not been arrived at, the player is reverted back to the play or quit option. If the player's number that has been derived is part of the safe's combination the next threshold of the inquiry includes whether or not all three numbers have been discovered. If not all of the three numbers have been discovered, then the number that had been found has been denoted and made available to the player and then the direction of the knob 25 will be reversed to seek the next number in the safe's combination. On the other hand, should all numbers have been discovered then the bonus box 30 will be enabled and a random number generator will determine the magnitude of the multiplier associated with the bonus. Concomitantly, all of the reels contained in the box 32 will spin until a winning combination will have been displayed. The paytable associated with that winning combination is multiplied by the whole number multiplier associated with box 30. This increments the player award and also at the same time reinitializes the safe so that a new three number combination is selected at random.

By virtue of the foregoing, it should be evident that as a player or players become closer to the eventual outcome of the safe's combination, a greater incentive will be provided to continue play in order to discern and benefit from having discovered the combination of the safe. In this way, a player who heretofore knew that a series of subsequent losses have no upside, can be encouraged to play based on the assurance that a streak long enough will be rewarded by the combination of a multiplier in conjunction with the paytable associated with a recognized winning safe combination.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A method for playing a gaming machine simulating a safe having a combination, the steps including:

selecting a combination, keeping the combination a secret from a player, playing a game, evaluating an outcome of the game against a paytable, incrementing credit to the player if the outcome is found on the paytable, searching for the combination of the safe if the player does not have an outcome which is due an award from the paytable, and flagging a combination number when found.

2. A method for gaming, comprising the steps of:

making a wager to enable a gaming machine, evoking chance means to trigger an outcome, comparing the outcome to a paytable, awarding credits if the outcome is to be found on the paytable, advancing a solution to a randomly generated puzzle if the outcome is not found on the paytable, and awarding a prize upon discovery of the puzzle.

3. An apparatus for wagering, comprising, in combination:

wagering means to enable said apparatus, means for displaying a plurality of outcomes, means for displaying a combination of a simulative safe, means for incrementing an award due in the presence of a winning outcome, means for revealing portions of the combination as a function of a losing outcome, means for awarding a payout upon discovery of the combination.

* * * * *